US010648276B2

(12) United States Patent
Anderson et al.

(10) Patent No.: US 10,648,276 B2
(45) Date of Patent: May 12, 2020

(54) SLIP ARRANGEMENT

(71) Applicants: Gary Anderson, Humble, TX (US); James Doane, Friendswood, TX (US)

(72) Inventors: Gary Anderson, Humble, TX (US); James Doane, Friendswood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 77 days.

(21) Appl. No.: 15/971,472

(22) Filed: May 4, 2018

(65) Prior Publication Data

US 2019/0338605 A1 Nov. 7, 2019

(51) Int. Cl.

| | |
|---|---|
| ***E21B 33/129*** | (2006.01) |
| ***E21B 23/01*** | (2006.01) |
| ***E21B 19/10*** | (2006.01) |
| ***E21B 33/12*** | (2006.01) |
| ***E21B 23/06*** | (2006.01) |

(52) U.S. Cl.

CPC ..... *E21B 33/129* (2013.01); *E21B 19/10* (2013.01); *E21B 23/01* (2013.01); *E21B 23/06* (2013.01); *E21B 33/12* (2013.01)

(58) Field of Classification Search

CPC ..... E21B 23/01; E21B 23/06; E21B 33/12; E21B 33/129

See application file for complete search history.

(56) References Cited

U.S. PATENT DOCUMENTS

| | | | | |
|---|---|---|---|---|
| 2,496,546 | A * | 2/1950 | Lamb | E21B 23/01 166/138 |
| 3,584,684 | A * | 6/1971 | Anderson | E21B 33/1294 166/129 |
| 6,241,017 | B1 | 6/2001 | Doane et al. | |
| 8,893,779 | B2 * | 11/2014 | Treadaway | E21B 33/129 166/216 |
| 2006/0278404 | A1 * | 12/2006 | Fay | E21B 43/10 166/382 |
| 2007/0102165 | A1 * | 5/2007 | Slup | E21B 33/1204 166/387 |
| 2015/0021048 | A1 * | 1/2015 | Ruffo | E21B 23/01 166/382 |
| 2016/0084025 | A1 * | 3/2016 | Jeske | E21B 33/1292 166/387 |
| 2017/0101835 | A1 | 4/2017 | Webster et al. | |
| 2018/0023368 | A1 | 1/2018 | Anderson et al. | |
| 2018/0045017 | A1 | 2/2018 | Thornton et al. | |

OTHER PUBLICATIONS

Notification of Transmittal of the International Search Report and the Written Opinion of the International Searching Authority, or the Declaration; PCT/US2019/025822; dated Jul. 26, 2019; 8 pages.

* cited by examiner

*Primary Examiner* — Tara E Schimpf
(74) *Attorney, Agent, or Firm* — Cantor Colburn LLP

(57) ABSTRACT

A slip and cone arrangement including a slip having a centrally located cone interconnection feature, and a cone having a slip retention feature engageable with the interconnection feature. A slip including a body, the body having a T section, and an engagement section, the engagement section having a centrally located cone interconnection feature.

15 Claims, 8 Drawing Sheets

SLIP ARRANGEMENT

BACKGROUND

In the resource recovery industry many tools employ anchoring systems that maintain the tools in place within tubing or in the open hole. Oftentimes, a slip system is part of the anchor system. Commonly, slips employ a track at the side of each slip to ensure it is retained in the cone against which the slip is set. While the system mostly works as intended, it does suffer from a relatively short track length due to geometrical constraints of the slip system and hence slips can under some conditions be liberated from the cone. This is undesirable as it can sometimes result in poor set status or in loss of a slip entirely. The art then will well receive alternative constructions that overcome the drawbacks of the prior art.

SUMMARY

A slip and cone arrangement including a slip having a centrally located cone interconnection feature, and a cone having a slip retention feature engageable with the interconnection feature.

A slip including a body, the body having a T section, and an engagement section, the engagement section having a centrally located cone interconnection feature.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
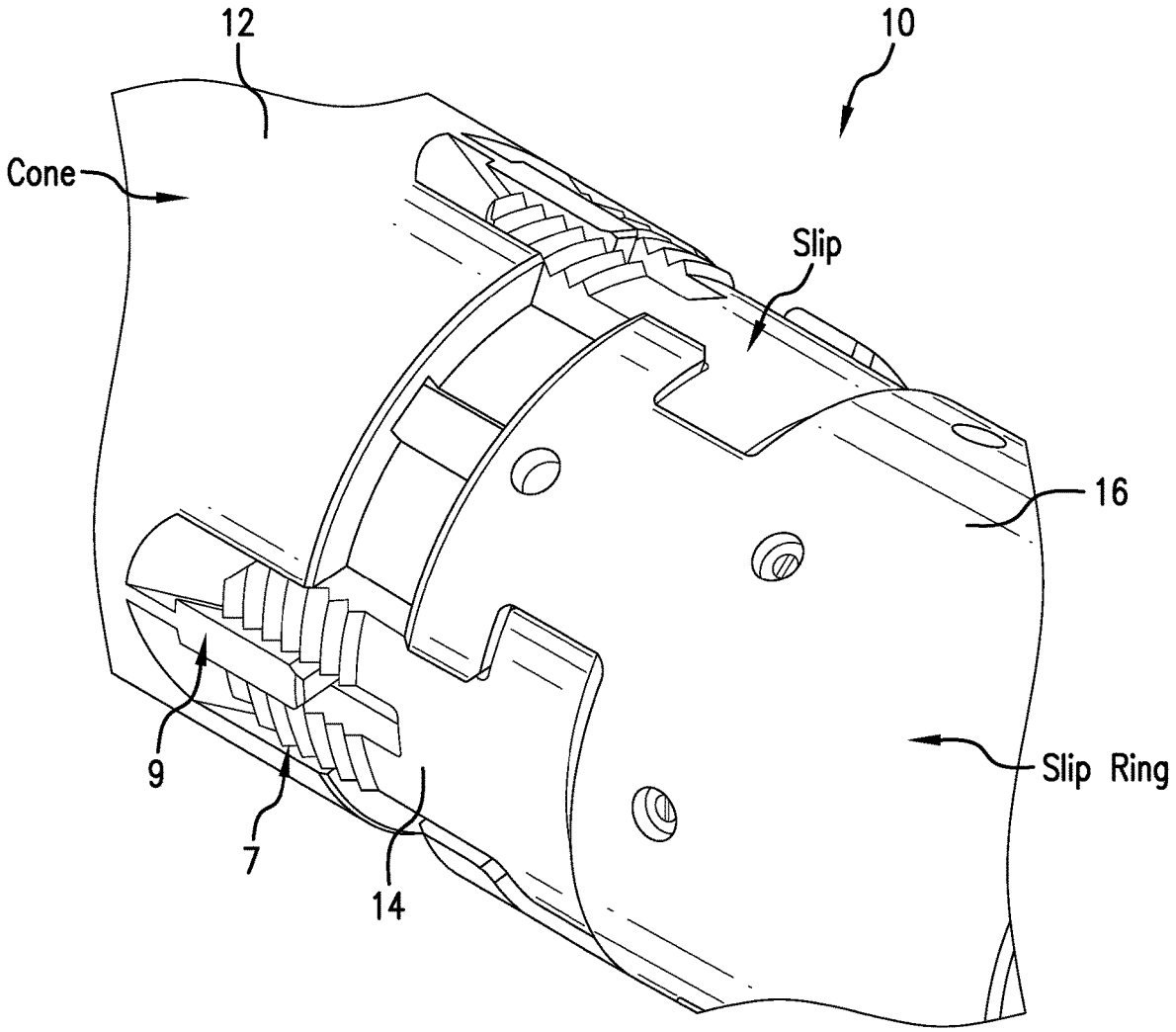
FIG. 1 is a perspective view of a slip arrangement as disclosed herein in a run in position.

Referring to FIG. 1, a perspective view of a slip arrangement 10 having a cone interconnection feature 7 and a slip retention feature 9 located centrally of each slip 14. "Centrally" or "center" as used herein are to be understood to mean toward a center, or at or near a center rather than only at the exact center. The arrangement 10 includes a cone 12, slips 14 and a slip ring 16. In FIG. 1, the arrangement is in a run in position wherein the slips 14 are below the drift diameter of the cone 12.

Figure 2:
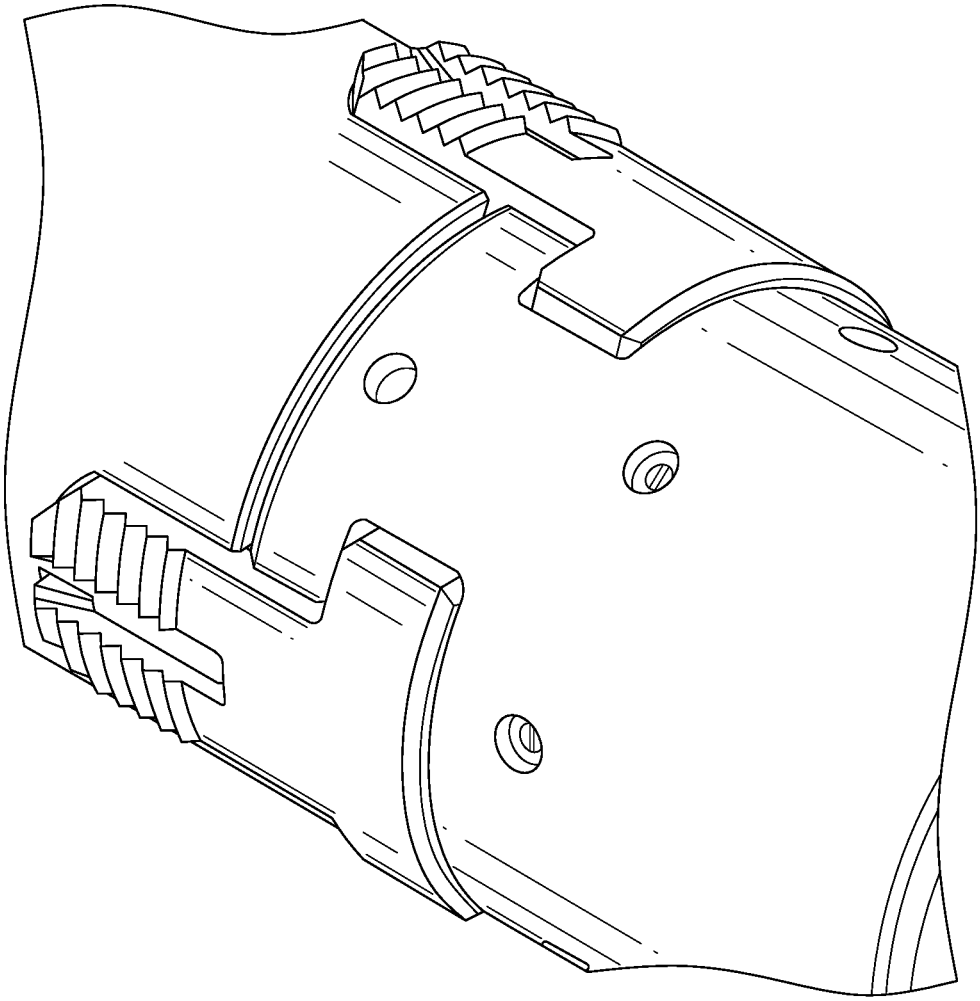
FIG. 2 is the view of FIG. 1 in a set position, the tubular in which the slip arrangement has been set not being illustrated but being understood to be bitingly engaged by the wickers on the slips.

FIG. 2 illustrates the system 10 with the slips shown in the set position, with the slips proud of the drift diameter of the cone 12 and hence a position in which they would be biting into a tubing in which the arrangement 10 is set.

Figure 3:
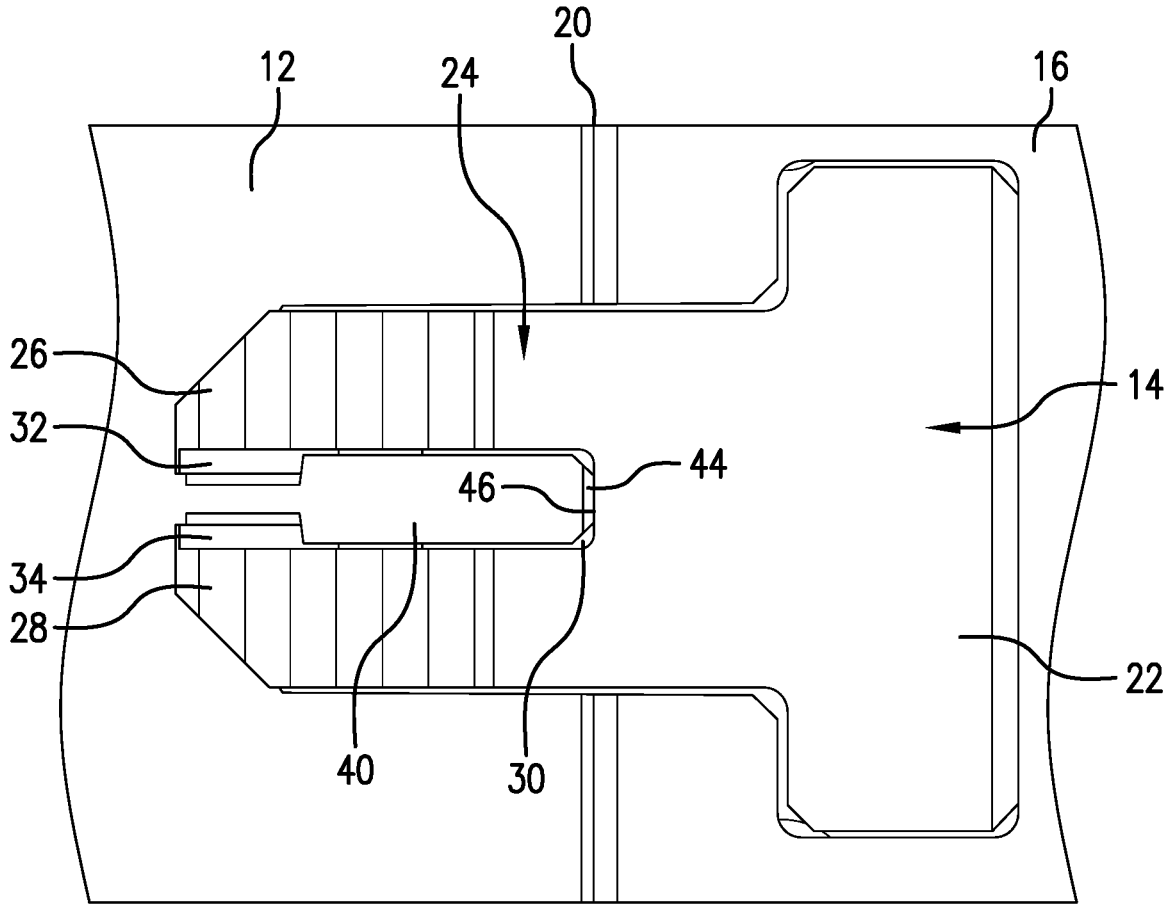
FIG. 3 is a plan view of one slip of the arrangement in the set position.
Figure 4:
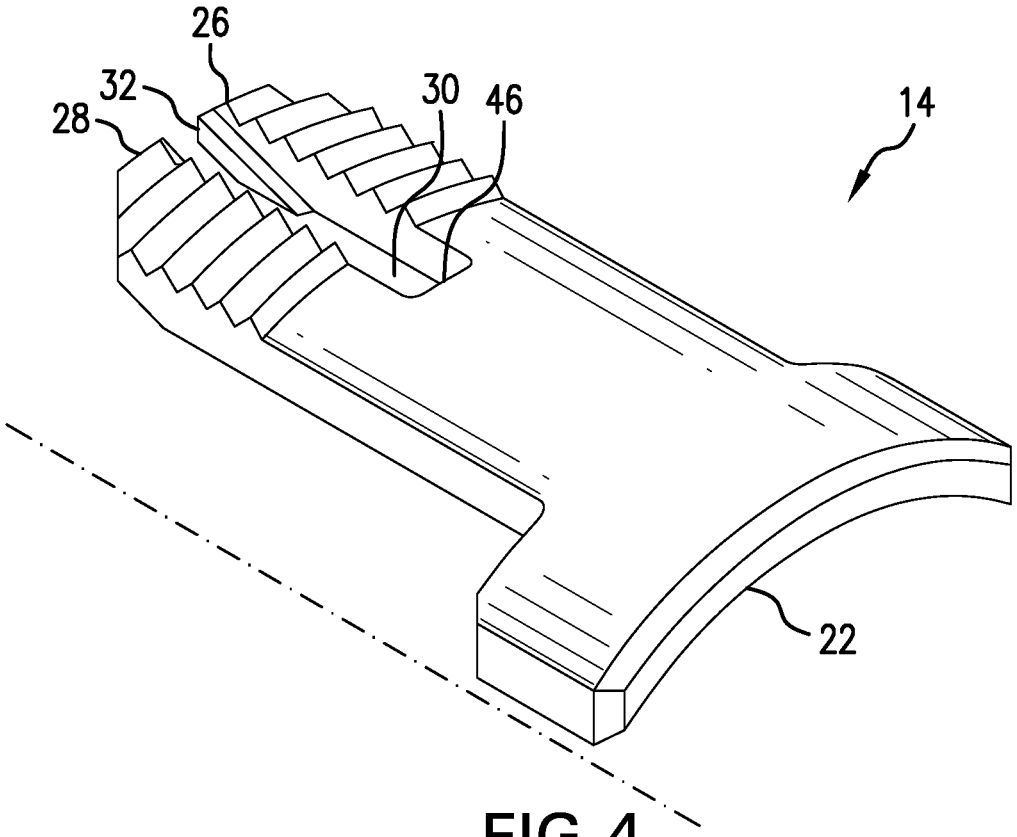
FIG. 4 is the slip as shown in FIG. 1.
Figure 5:
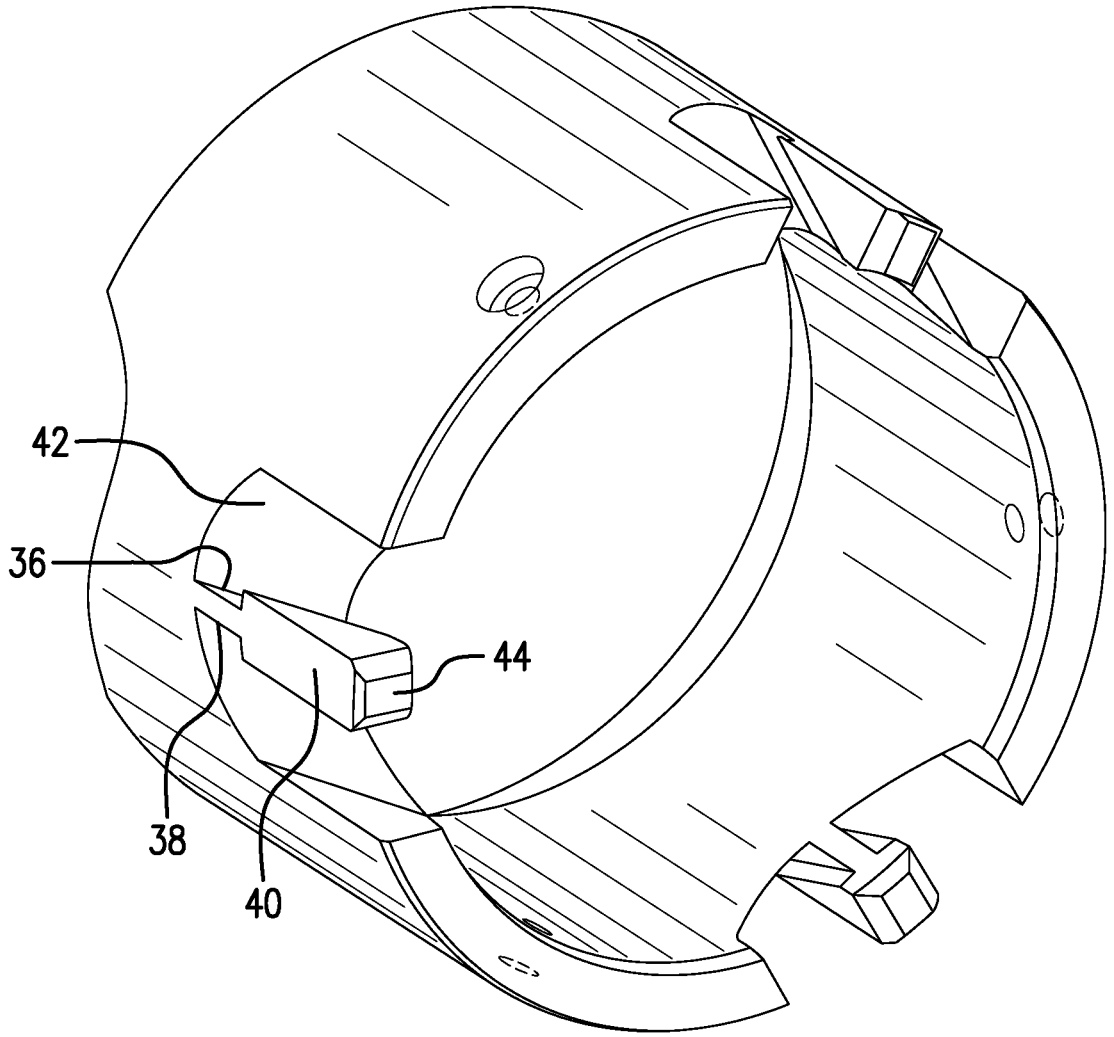
FIG. 5 is the cone as shown in FIG. 1.

It will be noticed in FIG. 1 that the slips 14 are different than what is known in the art. The cone 12 also includes geometry not known in the art. This can be better seen in FIGS. 3, 4, and 5. In FIG. 3, the cone 12 and slip ring 16 are shouldered against one another at line 20. Slip 14 is in the set position. Slip 14 includes a T feature 22 similar to prior art slips and an engagement section 24 quite distinct from the prior art. Slip 14 also includes a cone interconnection feature 7. The feature 7 comprises, in this embodiment, an engagement section 24 that is bifurcated having a first leg 26, a second leg 28 and a gap 30 defined by the legs 26 and 28. At the medial aspects of each leg 26 and 28 is a track flange 32 and 34, respectively. The positioning of the track flanges 32 and 34 medially ("medially" means toward a center but is not limited to at the exact center) of legs 26 and 28 as opposed to laterally of the slip 14, which is how the prior art is configured, provides for a longer engagement of the track flanges 32 and 34 with track grooves 36 and 38, respectively of a finger 40, which emanates from a ramp 42. This is because the slip 14 is relatively flat where it interacts with the ramp 42 and the outer surface of the cone 12 is a curved surface. The wider the flat portion (slip or ramp) gets, the closer it will be to the curved outer surface. The shorter the distance between the ramp and the outer surface, the shorter the track engagement can be and consequently the smaller the radial travel can be for the slip. The longer the track engagement the greater radial travel for the slip. Greater radial travel facilitates an increase in the range of casing sizes in which the slip arrangement is settable. This in turn allows for a reduction in the number of tools required for the number of casing sizes covered and overall in a reduction in required inventory.

Figure 6:
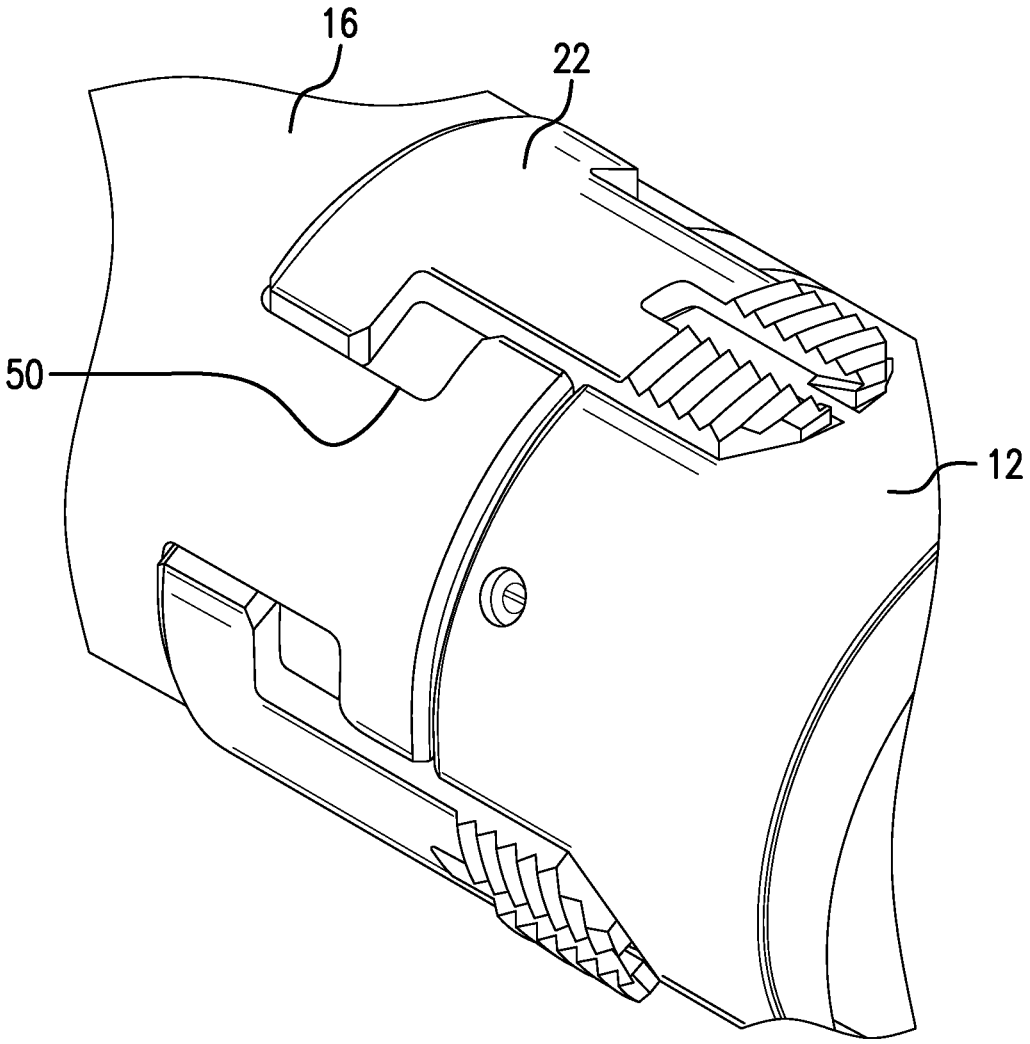
FIG. 6 is a perspective view of an alternate embodiment where the T-slot is oversized in the set position.
Figure 7:
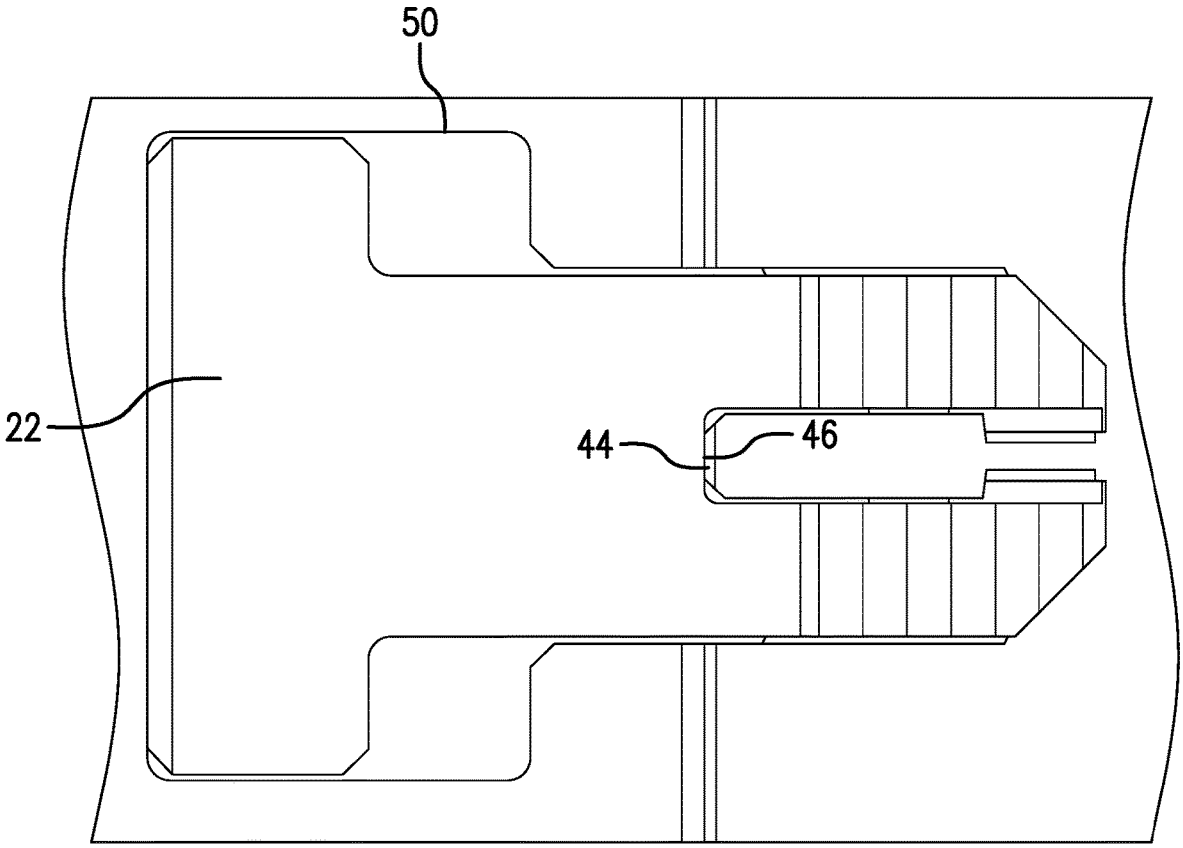
FIG. 7 is the embodiment of FIG. 6 in a plan view.

The finger 40 also includes a stop 44 that abuts the slip 14 at surface 46 to hard stop movement of the slip and prevent track disengagement. The stop 44 is included as shown in the embodiment of FIGS. 1-5 but is particularly important in the embodiment of FIGS. 6 and 7. This embodiment differs from the foregoing embodiment in that a T-slot 50 is oversized as seen in FIGS. 6 and 7. Such construction enables initial movement of the ring 16 during a retrieval operation without pulling on the slips 14 so that release of a release member elsewhere in the tool (not shown) such as a shear screw may be effected prior to the ring pulling on the slips 14. Otherwise, the slips 14 would be pulled at the same time as the release member is being pulled and the system may not disengage as intended. It will be appreciated that due to the oversized T-slot 50, the slips 14 could move in the direction toward the cone 12 and potentially disengage the track components 32, 34, 36, 38 but for the stop 44. This would lead to an escaped slip, which can cause all manner of difficulty for other tools or may simply fall to the bottom of the hole but even in that case, the particular tool that has lost a slip would need repair or replacement causing delay and expense. Due to the stop 44 as noted, this potential issue is avoided.

Figure 8:
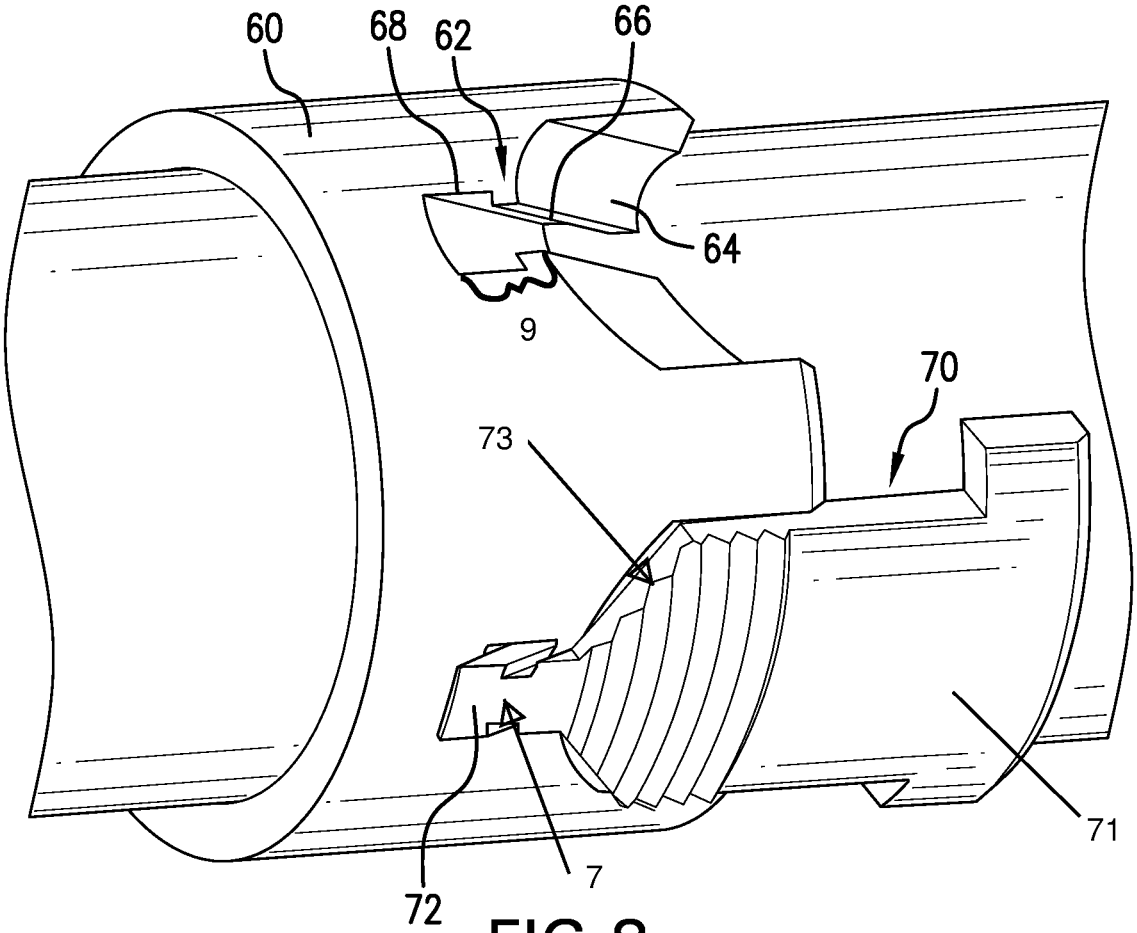
FIG. 8 is an alternate slip arrangement construction.

Referring to FIG. 8, an alternate embodiment of the slip and cone are illustrated. The same basic premise of providing a cone interconnection feature 7 and a slip retention feature 9 that operate near the center of the slip is retained but the construction is different. In this embodiment, cone 60 is configured with a recess 62 in a ramp surface 64. The recess 62 is a dovetail arrangement with a relatively narrower gate 66 and a relatively wider track 68. A slip 70 includes a nose 72 disposed at (or near) a midline of the slip 70 having a complementary structure to the recess 62 such that the nose 72 is engagable in the recess 62 to retain the slip in slidable engagement with the cone 60. The actual geometry of the gate and track are irrelevant so long as the complementary structure on the slip for engagement with the recess will be slidable therein but not disassembleable by drawing the portion of the complementary form of the track through the gate. The term "at" is intended to mean that the nose overlaps the longitudinal midline of the slip such that the nose 72 could be offset from the exact midline of the slip by some margin so long as the nose continues to overlap the midline. It will be appreciated by one of skill in the art that this configuration operates as does the previously described embodiments in that a greater radial travel is achieved so that the benefits described above remain applicable to this embodiment as well.

Set forth below are some embodiments of the foregoing disclosure:

Embodiment 1

A slip and cone arrangement including a slip having a centrally located cone interconnection feature, and a cone having a slip retention feature engageable with the interconnection feature.

Embodiment 2

The arrangement as in any prior embodiment, wherein the cone interconnection feature is slidably engageable with the slip retention feature such that the slip is movable relative to the cone in selected directions and prohibited from movement relative to the cone in other directions.

Embodiment 3

The arrangement as in any prior embodiment, wherein the interconnection feature comprises a bifurcation of a body of the slip.

Embodiment 4

The arrangement as in any prior embodiment, wherein the bifurcation creates two legs.

Embodiment 5

The arrangement as in any prior embodiment, wherein the bifurcation includes a track flange medially thereon.

Embodiment 6

The arrangement as in any prior embodiment, wherein the bifurcation is dimensioned positioned and configured to slidingly receive and engage with the slip retention feature.

Embodiment 7

The arrangement as in any prior embodiment, wherein the slip retention feature is a finger emanating from a ramp surface of the cone.

Embodiment 8

The arrangement as in any prior embodiment, wherein the finger includes a track groove receptive of a track flange centrally located on the slip.

Embodiment 9

The arrangement as in any prior embodiment, wherein the finger includes a stop.

Embodiment 10

The arrangement as claimed in claim 1 wherein the slip retention feature is a recess.

Embodiment 11

The arrangement as in any prior embodiment, wherein the recess is a dovetail.

Embodiment 12

The arrangement as in any prior embodiment, wherein the dovetail includes a relatively narrower gate and a relatively wider track.

Embodiment 13

The arrangement as in any prior embodiment, wherein the interconnection feature comprises a nose disposed at a longitudinal midline of the slip.

Embodiment 14

The arrangement as in any prior embodiment, wherein the nose is complementary to the slip retention feature.

Embodiment 15

The arrangement as in any prior embodiment, wherein the nose protrudes from the slip.

Embodiment 16

A slip including a body, the body having a T section, and an engagement section, the engagement section having a centrally located cone interconnection feature.

Embodiment 17

The slip as in any prior embodiment, wherein the engagement section includes a bifurcation.

Embodiment 18

The slip as in any prior embodiment, wherein the engagement section includes a nose configured positioned and dimensioned to interact with a recess in a cone.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A slip and cone arrangement comprising:

a slip having a centrally located cone interconnection feature including a bifurcation of a body of the slip and a track flange medially thereon; and a cone having a slip retention feature engageable with the interconnection feature.

2. The arrangement as claimed in claim 1 wherein the cone interconnection feature is slidably engageable with the slip retention feature such that the slip is movable relative to the cone in selected directions and prohibited from movement relative to the cone in other directions.

3. The arrangement as claimed in claim 1 wherein the bifurcation creates two legs.

4. The arrangement as claimed in claim 1 wherein the bifurcation is dimensioned positioned and configured to slidingly receive and engage with the slip retention feature.

5. The arrangement as claimed in claim 1 wherein the slip retention feature is a finger emanating from a ramp surface of the cone.

6. The arrangement as claimed in claim 5 wherein the finger includes a track groove receptive of a track flange centrally located on the slip.

7. The arrangement as claimed in claim 5 wherein the finger includes a stop.

8. The arrangement as claimed in claim 1 wherein the slip retention feature is a recess.

9. The arrangement as claimed in claim 8 wherein the recess is a dovetail.

10. The arrangement as claimed in claim 9 wherein the dovetail includes a relatively narrower gate and a relatively wider track.

11. A slip and cone arrangement comprising:

a slip having a centrally located cone interconnection feature; and a cone having a slip retention feature engageable with the interconnection feature, wherein the interconnection feature comprises a nose disposed at a longitudinal midline of the slip.

12. The arrangement as claimed in claim 11 wherein the nose is complementary to the slip retention feature.

13. The arrangement as claimed in claim 11 wherein the nose protrudes from the slip.

14. A slip comprising:

a body, the body having:

a T section; and an engagement section, the engagement section having a centrally located cone interconnection feature, wherein the engagement section includes a nose configured positioned and dimensioned to interact with a recess in a cone.

15. The slip as claimed in claim 14 wherein the engagement section includes a bifurcation.

* * * * *